United States Patent [19]

Libertini et al.

[11] Patent Number: 5,048,125

[45] Date of Patent: Sep. 17, 1991

[54] ATHLETIC SPORTSWEAR

[76] Inventors: Joseph Libertini; Deborah A. Libertini, both of 618 Country Club La., Havertown, Pa. 19083

[21] Appl. No.: 470,129

[22] Filed: Jan. 25, 1990

[51] Int. Cl.[5] ..... A41D 13/02; A63B 21/00

[52] U.S. Cl. ..... 2/79; 272/119

[58] Field of Search ..... 272/119, DIG. 9, 67; 2/79, 81

[56] References Cited

U.S. PATENT DOCUMENTS

| | | | |
|---|---|---|---|
| 3,490,768 | 1/1970 | Archer | 272/119 X |
| 3,532,339 | 10/1970 | Smith | 272/119 |
| 3,759,510 | 9/1973 | Jackson, Jr. | 272/119 |
| 3,945,042 | 3/1976 | Lobo | 2/2 |
| 4,268,917 | 5/1981 | Massey | 272/119 X |
| 4,303,239 | 12/1981 | Walsh, Jr. | 272/119 |
| 4,384,369 | 5/1983 | Prince | 272/119 X |
| 4,407,497 | 10/1983 | Gracie | 272/119 |

FOREIGN PATENT DOCUMENTS

| | | | |
|---|---|---|---|
| 1097350 | 6/1984 | U.S.S.R. | 272/119 |

*Primary Examiner*—Werner H. Schroeder
*Assistant Examiner*—Sara M. Current
*Attorney, Agent, or Firm*—Eugene E. Renz, Jr.

[57] ABSTRACT

An article of apparel for use as athletic sportswear sized to cover at least a portion of the torso, comprising at least two layers of fabric attached together to form the shape of the article. The layers are provided with a plurality of pockets between the layers and extending longitudinally along a portion of the length of the article. The pockets enclose flexible material of sufficient density to substantially increase the weight of the article.

4 Claims, 1 Drawing Sheet

ATHLETIC SPORTSWEAR

FIELD OF THE INVENTION

The present invention relates to articles of clothing which are worn as athletic sportswear, and more particularly to articles which are useful for improving the strength and general conditioning of persons who are physically active or desire to be so.

BACKGROUND OF THE INVENTION

It is generally conceded that large people are generally stronger than small people, although there are notable exceptions. For example, the world record for heavyweight weightlifters is significantly heavier than the world record for middleweight and lightweight weightlifters, even though the smaller lifters may lift more per pound of body weight. An opposite effect is noted where endurance is required, such as in long distance runners. Lighter runners tend to go faster for longer periods of time than stronger but much heavier runners. No one weighing two hundred pounds has ever come close to winning major marathon race, for example.

A fine athlete with excellent conditioning might be able to lift a certain amount of weight with his or her arm or leg, when using specific exercise apparatus. A larger person, very out of shape and not strong for his or her size, will, to the surprise of many, lift much more on the same apparatus. While part of that is due to increased leverage since larger persons tend to have longer arms and legs, that is not the only basis for the increased strength. There is a certain degree of strength which is derived from the work expended by walking around, carrying excess body weight.

We are often amazed at heavy persons, male or female, who dance well and seem "light" on his or her feet. It is truly amazing to know the strength that these people have. These same people struggle to climb two or three flights of stairs when lighter persons are hardly fazed by that same effort.

Recognizing that increased weight leads to increased strength and decreased endurance does not, by itself, suggest any obvious solution for improving conditioning. Taken to one extreme, Sumo wrestlers attempt to gain extreme amounts of weight to achieve great strength. At the same time, they are nearly exhausted at the end of a match which lasts fifteen or thirty seconds. More importantly, it has never been found to be successful as a conditioning exercise for an athletically inclined person to gain weight to achieve strength, followed by losing weight at the time when maximum performance is desired.

Some attempts to carry additional weight have been developed for training exercises. For example, joggers often times carry small weights in their hands and, as a result, achieve some strengthening of the arm muscles. Often times, however, strain in the shoulder, elbow or wrist causes more pain than gain. Weighted belts, wrists bands and leg bands have also placed dangerous strain on joints, particularly when enough weight is used to make a difference. As a result, no effective way to directly increase strength by having greater weight has been developed which does not adversely strain other parts of the body, causing more harm than good. There is no present device available to add a significant amount of body weight without placing potentially harmful strain on a person's joints.

SUMMARY OF THE INVENTION

It has now been discovered that the objects of the present invention can be accomplished in the following manner. Specifically, an article of apparel has been discovered which is admirably suitable for use as athletic sportswear to increase strength and endurance. The article of apparel covers at least a portion of the person's torso or trunk. The article comprises at least two layers of fabric which are attached together to form the shape of the article, such as a shirt or pants or both. The fabric layers are provided with a plurality of pockets between those layers, which are longitudinally extending along the length of the article. These pockets enclose particulate matter of sufficient density to substantially increase the weight of the article of apparel.

When a shirt is included as one of the articles of apparel of this invention, a preferred embodiment will include a shoulder sleeve with laterally extending pockets extending from the shoulder to the arm of the article. When pants are included as one portion of the article of apparel, the pants include hip and legs portions with longitudinally extending filled pockets of the type described herein.

The pockets in the article of apparel of the present invention are made by forming seams running longitudinally along at least a portion of the length of the article. The pockets are filled with sand or smooth gravel or other small natural or synthetic materials, preferably which have a high density, and which can move with respect to one another to permit bending or flexing during wearing the article. If the pockets are sufficiently full, the weight will be distributed along the entire length of the pocket, thereby distributing the weight over the length of a person's muscles and skeleton frame. In this manner, the article of apparel duplicates the process of gaining bodyweight in that the stress is spread over a maximum portion of the person's body while minimizing stress on the joints.

With extremely long pockets, it may be desirable to include restraining means to restrain flow of the particles in a downward direction, whereby at least twenty five percent (25%) of the particles and preferably forty percent (40%) of the particles are in the top one half of the pocket. Preferably the pockets are filled sufficiently to maintain this ratio of distribution.

In one embodiment, where the articles of apparel comprises two portions, a shirt portion and a pants portion, means may be provided to attached the two portions when they are worn together. Velcro tabs are admirably suited for this, since they allow for a wide latitude of adjustment to maximize comfort.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
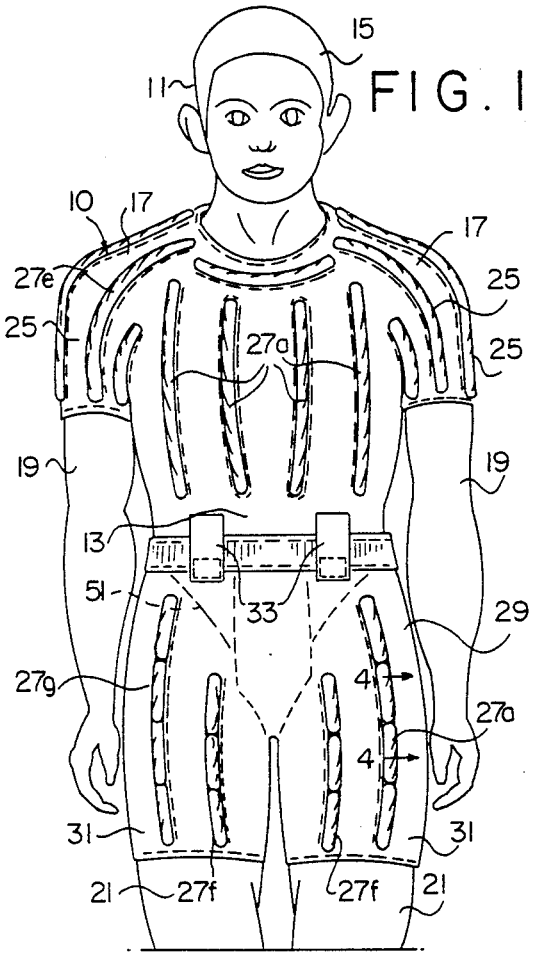
FIG. 1 is a schematic view showing a person wearing one embodiment of the present invention.
Figure 2:
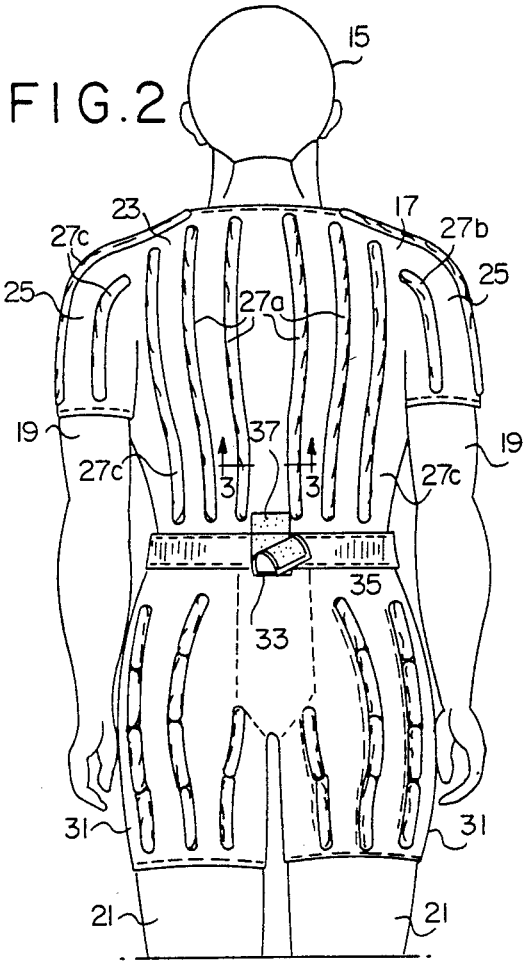
FIG. 2 is a schematic view of the embodiment shown in FIG. 1, as seen from the back.
Figure 4:
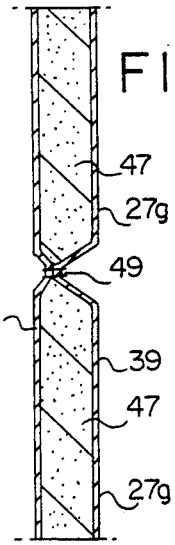
FIG. 4 is a sectioned view taken along 4—4 of FIG. 1.

As shown in FIG. 1, the device shown generally by the reference numeral 10 is worn by a person 11. The trunk 13 or torso of the human body is that portion of the human body apart from the head 15 and appendages. The article of this invention is sized to cover at least a portion of the trunk 13 or body portion of the person apart from the head 15. The shoulders 17 are generally laterally projecting parts of the human body, by which the arms 19 are connected with the trunk 13. As part of the trunk 13, hips, which are laterally projecting regions of each side of the lower or posterior part of the trunk 13 joining the lateral parts of the pelvis and upper part of the leg 21.

The essence of this invention is the attempt to closely replicate the weight carried by the body, to increase the strength and not decrease the endurance which might otherwise be acquired through strength and aerobic conditioning. Accordingly, a shirt 23 is provided for the person 11 who will be using the article of apparel.

The shirt 23 includes sleeves 25, although it is not necessary that the shirt 23 includes sleeves 25. There is, however, significant benefit in upper arm strength to be gained by including sleeves in the article of this invention.

The entire shirt 23 is provided with a plurality of pockets 27, such as 27*a* along the back; 27*b* on the shirt sleeves 25; 27*c* along the junction of the shirt 23 and sleeve 25; 27*d* on the front of the shirt 23; and 27*e* across the top of the shoulder 17 and extending from the shirt 23 to the sleeve 25. The number of pockets 27 will depend upon the amount of weight to be carried by the person as well as the density of the material being used. It is preferable to use sand or small stonelike material which feels smooth and which is capable of allowing enough flexibility to permit movement without rubbing or chafing without leaking through the fabric of the shirt 23. Pants 29 are constructed in the same manner, with legs 31 extending down with several lengths of pockets 27*f* and 27*g*.

When both the shirt 23 and the pants 29 are worn together, it may be desirable to provide means for attaching the two portions. Fastener 33 connects the shirt 23 and the pants 29, using a velcro patch 35 and matching tab 37 which can be adjusted for the convenience and comfort of the person using the articles of apparel.

Both the shirt 23 and the pants 29 are constructed from a double layer of material 39 and 41. Spandex is a preferred fabric for use with the present invention. Other fabrics such a nylon, cotton, and other are also suitable, provided that they are sufficiently strong to accommodate the strain at the seams, which is caused by the additional weight in the pockets 27. It is necessary that the fabric does not leak the small particles of sand or other particulate matter.

Figure 3:
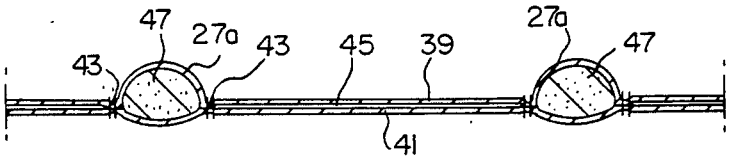
FIG. 3 is a sectioned view taken along line 3—3 of FIG. 2.

As shown in FIG. 3, the two sides 39 and 41 are joined together by seams 43. A portion of the shirt 23 or pants 29 will have panels which have space 45 between them, and these panels separate the pockets 27. The pockets 27 are filled with a particulate material 47, such as sand or smooth stone or other natural synthetic materials, which has sufficient density to add significant weight to the article of apparel. The seams 43 also extend to the top and bottom of the pockets 27 to totally enclose the particulate material 47. It is also possible to use an alternative filler for the particulate matter 47. For example, braided wire or chain or other continuous materials can be sewn into the pockets 27 if they are sufficiently flexible to follow the natural movement of the user and if they are sufficiently dense to provide a worthwhile increase in weight of the article.

The amount of weight added by the article of the invention will depend on the size of the person and the conditioning needs. Benefits can be obtained from as little as two or three pounds, to as much as one hundred pounds or more. A preferred range will be to increase the user's body weight from five to thirty percent or more. The weight should be sufficient to obtain benefits without overloading the user.

Because the shirt 23 or pants 29 are worn in one position, over a period of time there is the tendency of the small particulates 47 to move to the bottom of the pockets 27*g*, for example. In order to prevent migration of particles 47, it may be desirable to place transverse seams 49 which ensure that at least twenty five percent (25%) and preferably forty percent (40%) of the weight is in the top one half of the pocket 27.

Various modifications of the present invention are possible, of course, without departing from the spirit of this invention. For example, both the back and front of the shirt 23 and pants 29 have been shown as including weighted pockets 27. It is possible to put weight only in the back or the front of shirt 23, for example. In addition, seams can be sewn without weighted matter at the natural flex points of individuals, such as seam 51 shown in FIG. 1.

Having thus described the invention, what is claimed is:

1. An article of apparel for use as athletic sportswear made of a stretchable material and sized to cover at least a portion of the musculoskeletal frame of the wearer said article comprising at least two layers of fabric attached together to form the shape of said article, said layers being provided with a plurality of elongated pockets between said layers extending longitudinally along a portion of the length of said article, said pockets being spaced apart at a predetermined distance and enclosing particulate material of sufficient density to substantially increase the weight of said article, said pockets being of relatively small cross section to permit flexibility, said pockets including pocket divider means dividing each of said pockets into a plurality of pocket segments such that said particulate material is prevented from freely passing between said pocket segments, whereby said article provides equal distribution of the weight of said particulate material about said musculoskeletal frame.

2. The article of apparel of claim 1 such that said article covers the entire musculoskeletal frame of the wearer except for the hands, feet neck and head.

3. The device of claim 1 wherein said article includes two portions comprising a shirt portion and a pants portion.

4. The article of claim 3 which further includes detachable means to attach said two portions to one another.

* * * * *